US012059054B2

(12) United States Patent
Tominaga

(10) Patent No.: US 12,059,054 B2
(45) Date of Patent: Aug. 13, 2024

(54) INSOLE

(71) Applicant: SPIRAL TURN CO., LTD, Tokyo (JP)

(72) Inventor: Takuya Tominaga, Bundall (AU)

(73) Assignee: SPIRAL TURN CO., LTD., Tokyo (JP)

( * ) Notice: Subject to any disclaimer, the term of this patent is extended or adjusted under 35 U.S.C. 154(b) by 0 days.

(21) Appl. No.: 17/795,427

(22) PCT Filed: Jan. 25, 2021

(86) PCT No.: PCT/JP2021/002360
§ 371 (c)(1),
(2) Date: Jul. 26, 2022

(87) PCT Pub. No.: WO2021/153474
PCT Pub. Date: Aug. 5, 2021

(65) Prior Publication Data

US 2023/0052232 A1 Feb. 16, 2023

(30) Foreign Application Priority Data

Jan. 27, 2020 (JP) ..... 2020-010460
May 29, 2020 (JP) ..... 2020-094981

(51) Int. Cl.
*A43B 7/14* (2022.01)
*A43B 7/1415* (2022.01)
(Continued)

(52) U.S. Cl.
CPC ..... *A43B 17/00* (2013.01); *A43B 7/14* (2013.01); *A43B 7/1415* (2013.01); *A43B 7/145* (2013.01); *A43B 7/149* (2013.01)

(58) Field of Classification Search
CPC ..... A43B 7/141; A43B 7/149; A43B 7/1415; A43B 7/1425; A43B 7/30; A43B 7/14; A43B 7/1405; A43B 7/145
(Continued)

(56) References Cited

U.S. PATENT DOCUMENTS 1,730,466 A * 10/1929 Mallott ..... A43B 7/145 36/44
2,424,107 A * 7/1947 Mccahan ..... A43B 7/14 36/176
(Continued)

FOREIGN PATENT DOCUMENTS

CN 103099384 A 5/2013
CN 107485117 A 12/2017
(Continued)

OTHER PUBLICATIONS

Translation of the International Preliminary Report on Patentability for International Patent Application No. PCT/JP2021/002360, mailed Aug. 11, 2022, 8 pages.
(Continued)

*Primary Examiner* — Marie D Bays
(74) *Attorney, Agent, or Firm* — Withrow + Terranova, PLLC; Vincent K. Gustafson

(57) ABSTRACT

Provided is an insole to suppress, in a foot sole, an excessive outward displacement of the center of body gravity. An insole to be used as a shoe insole includes three areas divided from a top surface of the insole. The three areas include a forefoot area, a midfoot area, and a hindfoot area. In an outer section, all three areas are provided with an outer forefoot protrusion, an outer midfoot protrusion, and an outer hindfoot protrusion that protrude upwards from the top surface of the insole or downwards from a bottom surface of the insole. The protrusions are formed to have respective
(Continued)

heights of protrusion distinctive from one another within a range of 0.2 mm or higher and 15 mm or lower.

5 Claims, 11 Drawing Sheets

(51) Int. Cl.
*A43B 7/145* (2022.01)
*A43B 7/149* (2022.01)
*A43B 17/00* (2006.01)

(58) Field of Classification Search
USPC ..... 36/88, 93, 94, 95
See application file for complete search history.

(56) References Cited

U.S. PATENT DOCUMENTS

| | | | | | |
|---|---|---|---|---|---|
| 2,631,387 | A * | 3/1953 | Shaw | A43B 7/14 | 36/43 |
| 2,680,919 | A * | 6/1954 | Riggs | A43B 7/1425 | 36/155 |
| 2,961,780 | A * | 11/1960 | Mcmanus | A43B 7/1425 | 36/145 |
| 3,968,577 | A * | 7/1976 | Jackson | A43B 7/141 | 36/43 |
| 4,020,570 | A * | 5/1977 | Shames | A43B 17/14 | 36/44 |
| 4,446,633 | A * | 5/1984 | Scheinhaus | A43B 7/24 | D2/916 |
| 4,783,910 | A * | 11/1988 | Boys, II | A43B 7/1415 | 36/108 |
| 4,897,937 | A * | 2/1990 | Misevich | A43B 17/00 | 36/43 |
| 5,058,585 | A | 10/1991 | Kendall et al. | | |
| 5,063,692 | A * | 11/1991 | Suginaka | A43B 7/142 | 36/43 |
| 5,860,229 | A * | 1/1999 | Morgenstern | A43B 7/1415 | 36/141 |
| 5,992,055 | A * | 11/1999 | Connor | A43B 23/07 | 36/43 |
| 6,604,301 | B1 * | 8/2003 | Manoli | A43B 7/144 | 36/43 |
| 10,149,512 | B1 * | 12/2018 | Wurtz | A43B 7/143 | |
| 10,188,172 | B1 * | 1/2019 | Wurtz | A43B 17/00 | |
| 2004/0010945 | A1 * | 1/2004 | Eriksen | A43B 7/1425 | 36/180 |
| 2005/0115108 | A1 * | 6/2005 | Palchetti | A43B 17/02 | 36/141 |
| 2006/0254092 | A1 * | 11/2006 | Stevens | A43B 17/023 | 36/71 |
| 2007/0271820 | A1 | 11/2007 | Nurse et al. | | |
| 2008/0072455 | A1 * | 3/2008 | Svae | A61F 5/019 | 36/88 |
| 2010/0018078 | A1 * | 1/2010 | Bobbett | A43B 3/107 | 36/88 |
| 2010/0251568 | A1 * | 10/2010 | Haruda | A43B 17/102 | 36/43 |
| 2011/0179672 | A1 | 7/2011 | Cheng | | |
| 2013/0318826 | A1 * | 12/2013 | Nathaniel | A43B 17/14 | 36/97 |
| 2015/0272273 | A1 * | 10/2015 | Whittingham | A43B 7/145 | 36/43 |
| 2016/0095382 | A1 | 4/2016 | Takahashi et al. | | |
| 2016/0239014 | A1 * | 8/2016 | Piontkowski | A43B 7/142 | |
| 2017/0224048 | A1 | 8/2017 | Nagano et al. | | |
| 2019/0142107 | A1 | 5/2019 | Ferniani | | |
| 2020/0170340 | A1 * | 6/2020 | Kim | A43B 13/04 | |
| 2020/0178648 | A1 * | 6/2020 | Rini | A43B 7/149 | |
| 2021/0030113 | A1 * | 2/2021 | Schuster | B33Y 10/00 | |
| 2021/0289881 | A1 * | 9/2021 | Sugawara | A61F 5/14 | |
| 2021/0330021 | A1 * | 10/2021 | Engelman | A61F 5/0111 | |
| 2021/0361462 | A1 * | 11/2021 | Liu | A61F 5/01 | |

FOREIGN PATENT DOCUMENTS

| | | | | |
|---|---|---|---|---|
| JP | S59150309 | U | 10/1984 | |
| JP | S6361905 | U | 4/1988 | |
| JP | 3023540 | U | 4/1996 | |
| JP | H08112107 | A | 5/1996 | |
| JP | H11146802 | A | 6/1999 | |
| JP | 3108236 | U | 4/2005 | |
| JP | 2007089833 | A | 4/2007 | |
| JP | 2008062005 | A | 3/2008 | |
| JP | 2008161635 | A | 7/2008 | |
| JP | 2009172279 | A | 8/2009 | |
| JP | 2009247501 | A | 10/2009 | |
| JP | 2009538182 | A | 11/2009 | |
| JP | 2010264037 | A | 11/2010 | |
| JP | 5498631 | B1 | 5/2014 | |
| JP | 3203302 | U | 3/2016 | |
| JP | 2016042968 | A | 4/2016 | |
| JP | 2016214809 | A | 12/2016 | |
| JP | 2017148321 | A | 8/2017 | |
| JP | 2018023691 | A | 2/2018 | |
| JP | 2018161196 | A | 10/2018 | |
| JP | 6522754 | B2 | 5/2019 | |
| JP | 2019150275 | A | 9/2019 | |
| JP | 2019217063 | A | 12/2019 | |
| WO | WO-2018044954 | A1 * | 3/2018 | A43B 17/00 |

OTHER PUBLICATIONS

Examination Report No. 1 for Australian Patent Application No. 2021212882, mailed Mar. 27, 2023, 5 pages.
Explanation of circumstances concerning the early examination for Japanese Patent Application No. 2020010460, filed Feb. 9, 2020, 4 pages including English translation.
Notice of Reason(s) for Refusal for Japanese Patent Application No. 2020010460, mailed Jun. 5, 2020, 9 pages including English translation.
Decision of Refusal for Japanese Patent Application No. 2020010460, mailed Mar. 4, 2021, 8 pages including English translation.
Reconsideration Report by Examiner before Appeal for Japanese Patent Application No. 2020010460, mailed Jul. 13, 2021, 8 pages including English translation.
Notice of Reason(s) for Refusal for Japanese Patent Application No. 2020010460, mailed Dec. 20, 2021, 19 pages including English translation.
Notice of Reason(s) for Refusal for Japanese Patent Application No. 2020010460, mailed Jun. 29, 2022, 7 pages including English translation.
Explanation of circumstances concerning the early examination for Japanese Patent Application No. JP2020094981, filed Jun. 4, 2020, 4 pages.
Notice of Reason(s) for Refusal for Japanese Patent Application No. 2020094981, mailed Sep. 9, 2020, 6 pages including English translation.
International Search Report and Written Opinion for International Patent Application No. PCT/JP2021/002360, mailed Apr. 13, 2021, 23 pages including English translation.
Decision to Grant a Patent for Japanese Patent Application No. 2020-094981 mailed Oct. 21, 2020, 5 pages including English translation.
Trial and Appeal Decision for Japanese Patent Application No. 2020-010460 mailed Jan. 27, 2023, 3 pages including English translation.
Examination Report No. 2 for Australian Patent Application No. 2021212882, mailed Feb. 19, 2024, 4 pages.
Extended European Search Report for European Patent Application No. 21747624.1, mailed Jan. 23, 2024, 8 pages.

* cited by examiner

INSOLE

This application is a 35 U.S.C. § 371 national phase filing of International Application No. PCT/JP2021/002360, filed on Jan. 25, 2021, and claims the benefit of Japanese Patent Application No. 2020-094981 filed on May 29, 2020 and Japanese Patent Application No. 2020-010460 filed on Jan. 27, 2020, wherein the entire contents of the foregoing applications are hereby incorporated by reference herein.

TECHNICAL FIELD

The present invention relates to an insole to be placed as a shoe insert.

BACKGROUND ART

Conventionally known insoles (also known as foot sole plates or correction inserts) to be placed inside shoes include insoles having a special height in the center of foot arches. For example, according to the technique of Patent Document 1, an insole is provided with a protrusion to support a cuboid bone (arch part) from a foot sole, to thereby support an anterior part of the calcaneus and stabilize the entire tarsal bone including the calcaneus into a natural position.

PRIOR ART DOCUMENTS

Patent Documents

Patent Document 1: JP 5498631 B1

SUMMARY OF THE INVENTION

Problems to be Solved by the Invention

There is a large number of conventional insoles focusing on merely supporting arches of feet soles without purposes specifically defined. On the other hand, there is no insole shape specialized to suppress a motion (swaying) in which the center of body gravity excessively sways outwards during sports in general and a walking motion.

Furthermore, there is no insole shape specialized to purposely control a movement of the center of body gravity by adjusting a thickness of an arch configuration in millimeter units and/or providing a toe part with a specific shape, thereby adjusting use of a toe(s), a direction to perform push-off, and a push-off force.

The present invention is made in light of the above-described circumstances and is directed to provide an insole to suppress, in the foot sole, an excessive outward displacement (outward movement) of the center of body gravity. Furthermore, the present invention is directed to provide an insole to encourage push-off with a specific part of the foot in the vicinity of the hallux and improve a push-off force.

Means for Solving the Problems

To solve the problems described above, the present invention is an insole to be used as a shoe insert. The insole comprises three areas divided from a top surface of the insole. The three areas include a forefoot area, a midfoot area, and a hindfoot area. The forefoot area, the midfoot area, and the hindfoot area, respectively, are provided with, in all of respective outer parts thereof, an outer forefoot protrusion, an outer midfoot protrusion, and an outer hindfoot protrusion that protrude upwards from the top surface of the insole or downwards from a bottom surface of the insole. The outer forefoot protrusion, the outer midfoot protrusion, and the outer hindfoot protrusion are formed to have respective heights of protrusion distinctive from one another within a range of 0.2 mm or higher and 15 mm or lower.

Furthermore, it is preferable that the height of the outer forefoot protrusion is formed in a range of 1.5 mm to 7 mm, the height of the outer midfoot protrusion is formed in a range of 0.2 mm to 10 mm, and the height of the outer hindfoot protrusion is formed in a range of 1.5 mm to 10 mm.

Still further, the outer forefoot protrusion may be formed to push up a human foot sole upwardly in an outer area of the human foot sole from a vicinity of bottoms of a fifth metatarsal and a fourth metatarsal, through a vicinity of a fifth metatarsophalangeal joint and a fourth metatarsophalangeal joint, to a vicinity of a fifth phalanx and a fourth phalanx. The outer midfoot protrusion may be formed to push up the human foot sole upwardly in a part of the human foot sole just below a cuboid bone or slightly distanced from the cuboid bone to a height higher than an arch height of an inner edge of a navicular bone. The outer hindfoot protrusion may be formed to push up an outer side of a calcaneus upwardly to a height higher than an inner side of the calcaneus.

Still further, the forefoot protrusion, the midfoot protrusion, and the hindfoot protrusion may be formed integrally and continuously.

Still further, the forefoot area may be provided with, in an inner edge thereof, a second protrusion.

On the other hand, the present invention is an insole to be used as a shoe insert. The insole comprises three areas divided from a top surface of the insole. The three areas include a forefoot area, a midfoot area, and a hindfoot area. The forefoot area is provided with, in an inner part thereof, a set of inner forefoot protrusions protruding upwards from the top surface of the insole or downwards from a bottom surface of the insole. The set of inner forefoot protrusions is arranged so as to surround an outer periphery of a hallux as viewed in a plane. The set of inner forefoot protrusions is configured with a combination of one or more of a first protrusion, a second protrusion, a third protrusion, a fourth protrusion, or a fifth protrusion. The first protrusion is arranged in the vicinity of a proximal phalanx between a hallux and a second toe of a foot. The second protrusion extends in a toe direction from the first protrusion. The third protrusion extends from the first protrusion in a direction toward the hallux across a hallux proximal phalanx. The fourth protrusion is arranged so as to conform to a vicinity of a rear edge of an inner ball of the foot. The fifth protrusion is arranged along a curve of an inner edge of the insole from the vicinity of the rear edge of the inner ball of the foot.

Effects of the Invention

In the insole according to the present invention, there is one protrusion protruding upwards from the top surface of the insole or downwards from the bottom surface of the insole with a height of 0.2 mm or higher and 15 mm or lower in the outer part of one of the forefoot area, the midfoot area, or the hindfoot area. Alternatively, there are such protrusions in the outer parts of two of the forefoot area, the midfoot area, or the hindfoot area. Still alternatively, there are such protrusions in all of the three outer parts of these three areas. Thus, due to the outer part of the foot sole of the user being pushed up upwards, the COP is inhibited from being displaced outwards and is guided in an inner direction (toward the hallux). A movement trajectory of the COP has characteristics that it is reflected in a movement trajectory of the center of body gravity (located in the vicinity of the pelvis when a person is in the upright position). Thus, purposely guiding the movement trajectory of the COP results in correction of the movement trajectory of the center of body gravity, and thereby it is possible to lead to an efficient motion in which the excessive outward displacement of the center of body gravity is suppressed.

Furthermore, in the insole according to the present invention, the top surface of the insole is divided into the three areas including the forefoot area, the midfoot area, and the hindfoot area. The inner part of the forefoot area is provided with the set of inner forefoot protrusions that protrudes upwards from the top surface of the insole or downwards from the bottom surface of the insole and that is arranged so as to surround the outer periphery of the hallux as viewed in a plane. As a result, it is possible to encourage push-off with a specific part in the vicinity of the hallux and improve a push-off force.

MODE FOR CARRYING OUT THE INVENTION

Figure 1:
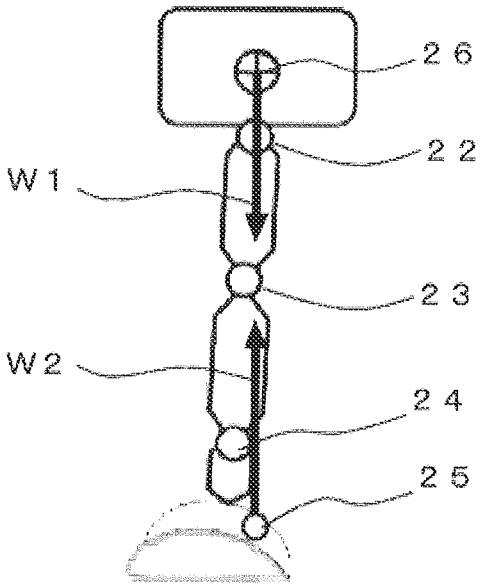
FIG. 1 is a schematic view illustrating a center of body gravity and a ground reaction force.

All motions daily performed by humans are movements to control a center of body gravity 26. In order to control the center of body gravity 26, a COP (center of pressure) is a biomechanically important. First of all, the COP is briefly described. FIG. 1 illustrates that a body model having a robot-like shape without an upper body is placed in a stationary state on an object having an approximately half-oval shape. This is to facilitate visual understanding of a relation between the COP and the center of body gravity when a person is in a standing position.

As illustrated in FIG. 1, there is a force W1 to act in a direction of gravity from the center of body gravity 26. The force W1 is transmitted to a foot 25 through a hip joint model 22, a knee joint model 23, and a foot joint model 24, and acts on a floor through the object on a sole of the foot 25. On the other hand, there is generated, over the entire sole of the foot 25, a reaction force (hereinafter, referred to as a ground reaction force W2) to be received from the floor through the object on the sole of the foot.

The COP is widely used in a scientific computation as a point of origin of a composite vector (ground reaction force W2) of the force acting over a contact surface between the sole of the foot 25 and the object. The magnitude and the direction of the ground reaction force W2 to be generated from the COP physically determine movements of body joints including a movement of the center of body gravity. A line Y of FIG. 2, drawn on feet LF, LR, indicates an ideal movement trajectory of the COP during walking. By optimizing the movement trajectory Y of the COP, which varies between individuals, it is possible to physically improve sports performance as well as to improve walking gait and relieve pain.

First Embodiment

The movement trajectory Y of the COP includes a feature to influence a movement trajectory Z of the center of body gravity 26. That is, as the movement trajectory Y of the COP changes, so does the movement trajectory Z of the center of body gravity 26. The situation where the center of body gravity 26 is excessively displaced (swayed) outwards is often considered to mean that the COP, which influences the center of body gravity 26, is also excessively displaced outwards.

By utilizing such physical characteristics, to thereby purposely manipulate the COP in the foot 25 with an insole 30, it is possible to suppress an excessive outward displacement of the center of body gravity 26.

Figure 3:
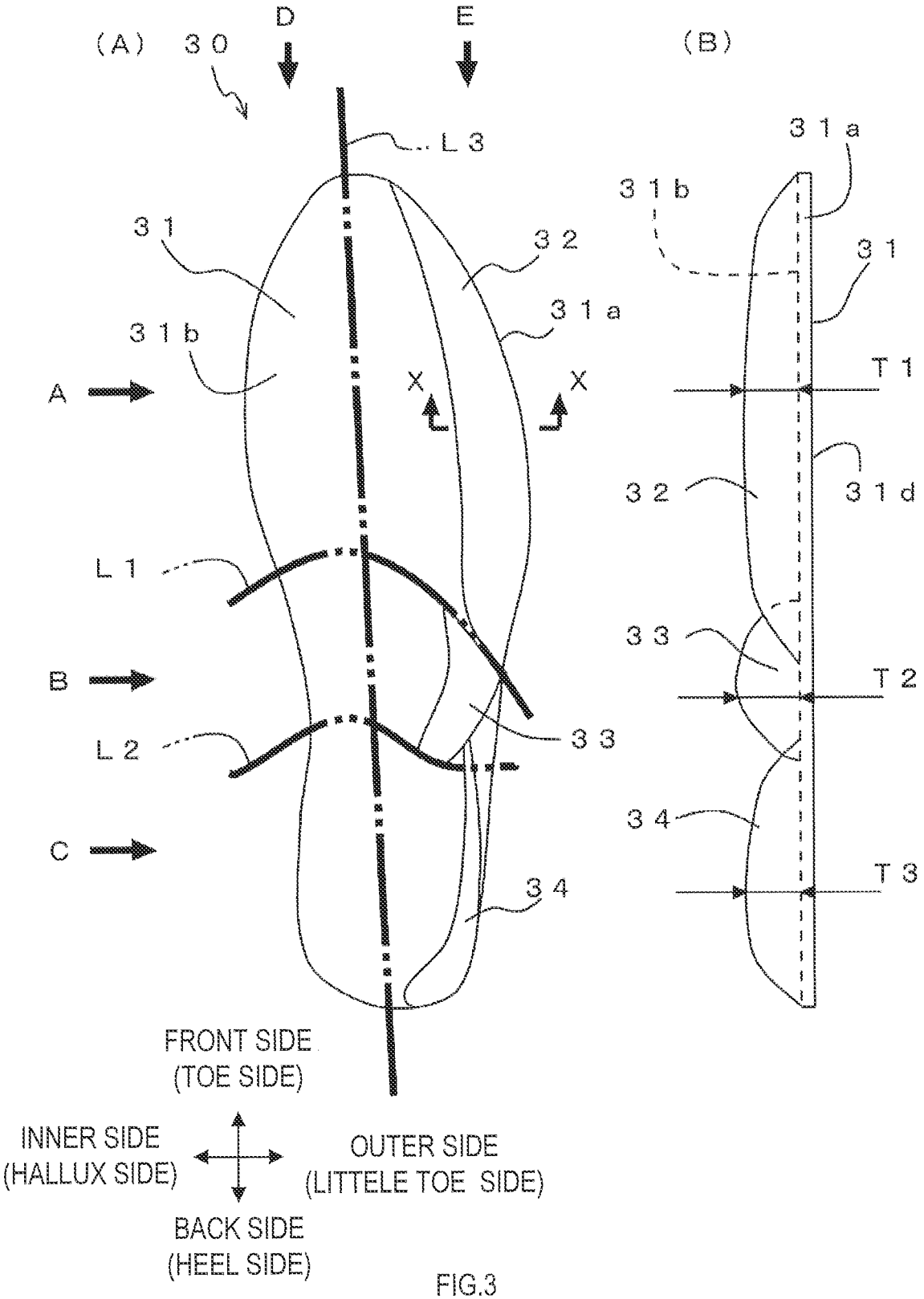
FIG. 3 is a view of an insole alone according to an embodiment of the present invention, in which an illustration (A) is a plane view and an illustration (B) is a right-side view of the illustration (A).
Figure 4:
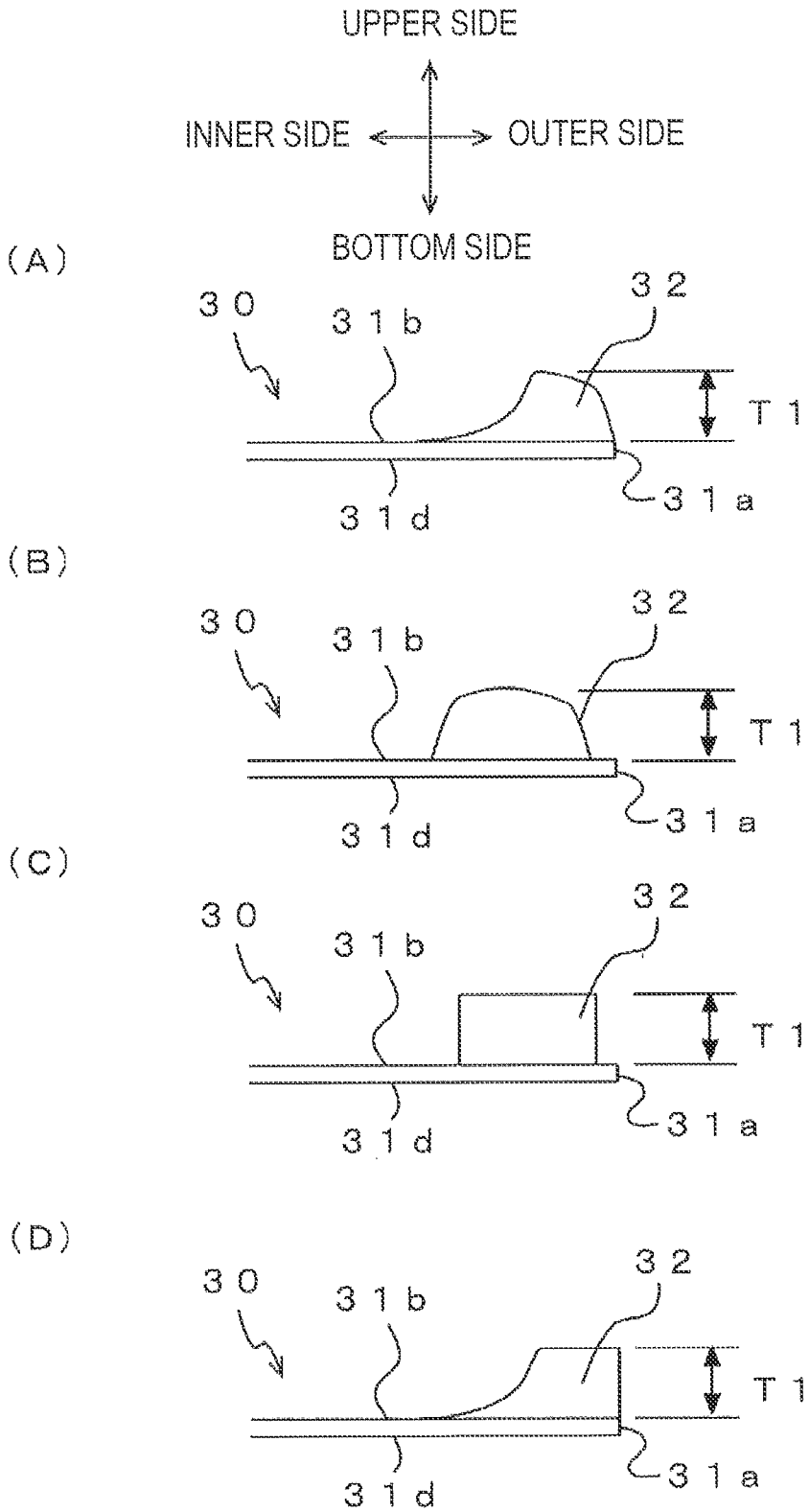
FIG. 4 is a cross-sectional view along a line X-X in FIG. 3.
Figure 5:
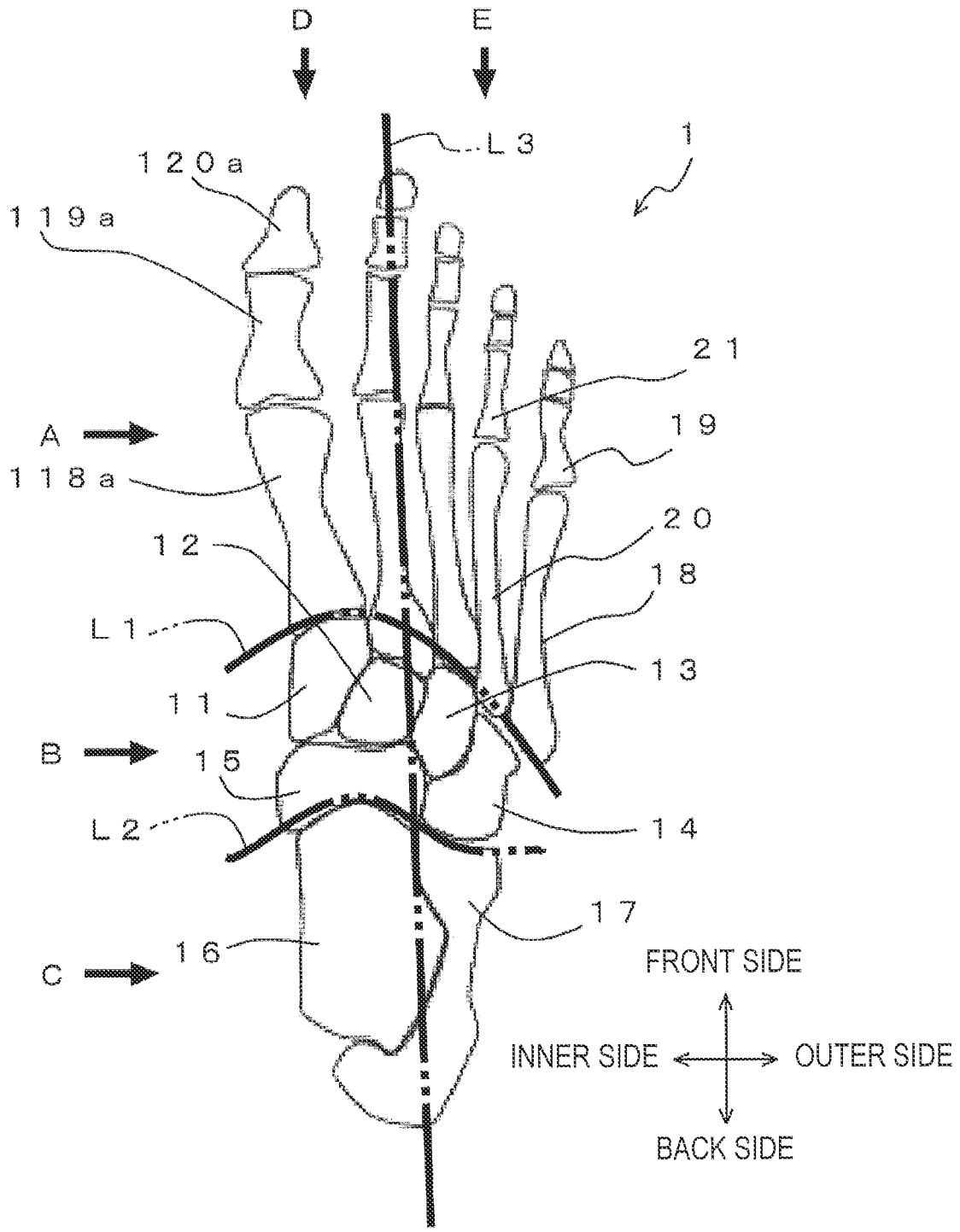
FIG. 5 is a plane view of human foot bones.

FIG. 3 is the insole 30 according to the embodiment of the present invention, in which an illustration (A) is a plane view and an illustration (B) is a right-side view of the illustration (A). Furthermore, FIG. 4 is a cross-sectional view along a line X-X in the illustration (A) of FIG. 3. Still further, FIG. 5 is a plane view of foot bones.

The insole 30 illustrated in FIG. 3 is for the right foot, and an insole for the left foot has a bilaterally symmetric configuration. For this reason, the following descriptions are given to the insole 30 for the right foot, and descriptions of the insole for the left foot are omitted. It should be noted that a strict comparison shows, when performed, that the left and right feet have bilaterally asymmetric shapes depending on a user. However, on the premise that such asymmetry is within individual differences, the descriptions proceed, deeming the left and right feet to be bilaterally symmetric.

Furthermore, the insole(s) referred in the present invention includes removable insoles to be pre-furnished with shoes during a production process of the shoes and insoles sewn into shoes, as well as insoles to be separately placed and used in fabricated shoes by the user.

As illustrated in the illustration (A) of FIG. 3, the insole 30 is formed to have a shape similar to a contour shape (middle sole shape) that matches the inside of a shoe. The insole 30 is divided into 6 areas by area lines L1, L2, L3 as viewed from the top. These area lines L1, L2, L3 and the division of the insole 30 into areas A through E are determined based on a structure of foot bones 1 of humans as illustrated in FIG. 5.

The foot bones 1 of humans can be divided into three areas A, B, and C in front-rear directions. Specifically, the three areas A, B, and C are: a forefoot area A (a distal part from the Lisfranc joint consisting of the fifth metatarsal 18, the fifth phalanx 19, the fourth metatarsal 20, and the fourth phalanx (phalanges are a collective term of the proximal phalanx, the middle phalanx, and the distal phalanx); a midfoot area B (between the Chopart joint and the Lisfranc joint consisting of the cuneiform bones 11, 12, 13, the cuboid bone 14, and the navicular bone 15); and a hindfoot area C (a proximal part to the Chopart joint consisting of the calcaneus 17 and the talus bone 16). The area lines L1, L2 are lines to schematically divide the foot bones 1 into these areas A, B, and C.

Furthermore, there is provided a single area line L3, connecting the leading end of the second toe to the most posterior protrusion of the calcaneus approximately vertically to the plane of paper of FIG. 5, and thereby the foot bones 1 is divided into two areas (an inner section D, an outer section E) on the left and right across the area line L3.

The positions of the area lines L1 through L3 illustrated in FIG. 5, respectively, correspond to positions of the area lines L1 through L3 illustrated in the illustration (A) of FIG. 3.

The insole 30 comprises a sole insert 31 having a fixed thickness and a shape traced so as to match an inner shape the shoe; and an outer forefoot protrusion 32, an outer midfoot protrusion 33, and an outer hindfoot protrusion 34 that protrude upwards from a top surface 31*b* of this sole insert 31.

As the outer forefoot protrusion 32, the outer midfoot protrusion 33, and the outer hindfoot protrusion 34 are formed integrally with the sole insert 31, the heights and/or the shapes of the protrusions 32, 33, 34 can be changed by cutting each of the protrusions 32, 33, 34. Each of the protrusions 32, 33, 34 may be formed as a piece separate from the sole insert 31, and thereby the heights and/or the shapes of the protrusions 32, 33, 34 can be appropriately changed by attaching each protrusion to the sole insert 31 and/or cutting the same.

As illustrated in the illustration (A) of FIG. 3, the outer forefoot protrusion 32 is formed in a manner to integrally and continuously extend and to have a width gradually increasing from a position spaced outwards a small distance from a point where an upper edge of the sole insert 31 and the area line L3 intersect to a position close to the area line L1 along an outer edge part 31*a* of the sole insert 31.

It should be noted that the above-described shape of the outer forefoot protrusion 32 is one example and may be variously modified to conform to a body condition of the user. In the illustration (A) of FIG. 3, the outer forefoot protrusion 32 has no space (gap) from the outer edge part 31*a* of the sole insert 31. However, for example, the outer forefoot protrusion 32 may be formed to have a space between itself and the outer edge part 31*a*. Furthermore, in the illustration (A) of FIG. 3, the outer forefoot protrusion 32 is formed integrally and continuously in the front-rear directions. However, two or more protrusions may form a single mass of protrusions, which may form a protrusion equivalent to the outer forefoot protrusion 32.

Still further, the outer midfoot protrusion 33 integrally and continuously extends inwards (toward the area line L3) from the position close to the area line L1 to a position close to the area line L2 with a space provided from the outer edge part 31*a* of the sole insert 31.

It should be noted that the shape of the outer midfoot protrusion 33 may also be variously modified to conform to the body condition of the user. In the illustration (A) of FIG. 3, the outer midfoot protrusion 33 extends inwards. However, for example, the outer midfoot protrusion 33 may be formed to extend vertically in the front-rear directions with respect to the plane of the paper of FIG. 3. Furthermore, as in the outer forefoot protrusion 32, two or more protrusions may form a single mass of protrusions, which may form a protrusion equivalent to the outer midfoot protrusion 33.

Still further, the outer hindfoot protrusion 34 extends rearwards from the position close to the area line L2 with a space provided from the outer edge part 31*a* of the sole insert 31. The outer hindfoot protrusion 34 is formed integrally and continuously in a manner to curve inwards (toward the area line L3) so as to correspond to a shape of a rear end portion of the sole insert 31.

It should be noted that the shape of the outer hindfoot protrusion 34 may also be variously modified. In the illustration (A) of FIG. 3, the outer hindfoot protrusion 34 is formed integrally and continuously in the front-rear directions. However, for example, two or more protrusions may form a single mass of protrusions, which may form a protrusion equivalent to the outer hindfoot protrusion 34.

As described above, the shape of each of the protrusions 32, 33, 34 as viewed from the top is one example and varies depending on a purpose of use, such as the shape of shoe to be used, the shape of foot of the user, the type of sports, and the like. It should be noted that, in any case, each of the protrusions 32, 33, 34 is formed within the outer section E in the sole insert 31.

There is provided a height T1 from a top surface 31*b* of the sole insert 31 (that is a surface in the plane of the paper of the illustration (A) of FIG. 3 and is a reference point to define a height of each of the protrusions 32, 33, 34) to the outer forefoot protrusion 32. The height T1 is formed within a range of 0.2 mm or higher to 15 mm or lower. As this height also varies depending on the body condition of the user and the purpose of use, a permissible range of plus/minus several millimeters is set.

The reason why the height T1 is set to be 0.2 mm or higher is as follows. In general, the human foot sole has been medically known to be a body part extremely excellent in a distinguishing ability that enables recognition of a height difference of at least 2 mm. The foot sole always exchanges, with the cerebrum, information on the shape of the ground and the position of the COP. As discussed above, when there is a recognizable change in the shape of the foot sole, the position of the COP and a moving speed of the COP changes simultaneously. Furthermore, these changes may result in a change in the movement of the center of body gravity. Thus, although it feels that 0.2 mm is such a small height in the daily life sense, the height of 0.2 mm is medically and physically significant in that it is a change to influence the foot sole and thus the entire body. For the reason above, the height is defined to be 0.2 mm or higher in the present invention. In particular, in the case of top athletes or the like requiring a consideration to a delicate sensory change, it is preferable to select a height of 0.2 mm or higher.

Furthermore, when the height is 0.6 mm, there is more significant change in the movement of the center of body gravity. A height of 1 mm or higher increases a rate in which the user can subjectively feel the change in the movement by himself/herself. Even when the user cannot subjectively feel the change in the movement, it is a general phenomenon that the change in the movement occurs objectively. The height of 0.2 mm or higher brings an effect to suppress the excessive outward displacement of the COP.

The reason why the height T1 is set to be 15 mm or lower is as follows. The skeleton of the human foot, which differs variously, has been known to fall within a certain range of height. On this premise, various standards have been drafted including Japanese Industrial Standards (JIS). Thus, in setting an upper limit of the height of the protrusion, it is necessary to consider the human skeleton and its variation, to thereby determine the upper limit. In the present invention, based on data of more than 2500 cases uniquely collected, a conclusion has been made that the height T1 available for the foot sole is 15 mm at the maximum.

Furthermore, when the height T1 is too high, long hours of use sometimes applies a load onto the knee joint and the foot sole. When the height T1 of more than 15 mm is used, about 15% of users complained of discomfort within one week from the use. By setting the height T1 to 11 mm or lower, the complaint of discomfort during the same time period has decreased to about 4%. Accordingly, in order reduce a rate in which discomfort arises to 5% or less, it is more preferable to set the height T1 to 11 mm or lower.

Still further, by setting the height T1 to 7 mm or lower, the complaint of discomfort has decreased to 1% or less. In other words, it is the height T1 of 7 mm or less that can reduce the complain of discomfort and maintain the effect. Determination of which to choose, among these heights of 15 mm or less, is made in light of the body condition, the type of footwear, and/or the like of each user.

Furthermore, for the same reason as in the outer forefoot protrusion 32, a height T2 and a height T3, respectively, of the outer midfoot protrusion 33 and the outer hindfoot protrusion 34 are formed within a range of 0.2 mm or higher and 15 mm or lower, preferably within a range of 0.2 mm or higher and 11 mm or lower, and more preferably within a range of 0.2 mm or higher and 7 mm or lower.

In an outer area (little toe side) of the human foot sole from a vicinity of bottoms (bases) of the fifth and fourth metatarsals 18, 20 through a vicinity of the fifth and fourth metatarsophalangeal joints (in the vicinity of the outer ball of the foot) to a vicinity of the fifth and fourth phalanges 19, 21, the outer forefoot protrusion 32 functions so as to push up the foot sole in an upward manner or an upwardly and inwardly inclining manner by a height corresponding to the height of the protrusion 32.

Furthermore, the outer midfoot protrusion 33 functions so as to push up a part of the foot sole, just below the cuboid bone 14, or slightly distanced from the cuboid bone 14 (in the vicinity of the third and fourth metatarsal bases), or just below the cuneocuboid joint (a joint surface between the outer cuneiform bone and the cuboid bone), in an upward manner or an upwardly and inwardly inclining manner to a height higher than an arch height of the inner edge of the navicular bone.

Still further, the outer hindfoot protrusion 34 functions so as to push up an outer side of the calcaneus 17 in an upward manner or an upwardly and inwardly inclining manner to a height higher than an inner side of the calcaneus 17.

Figure 2:
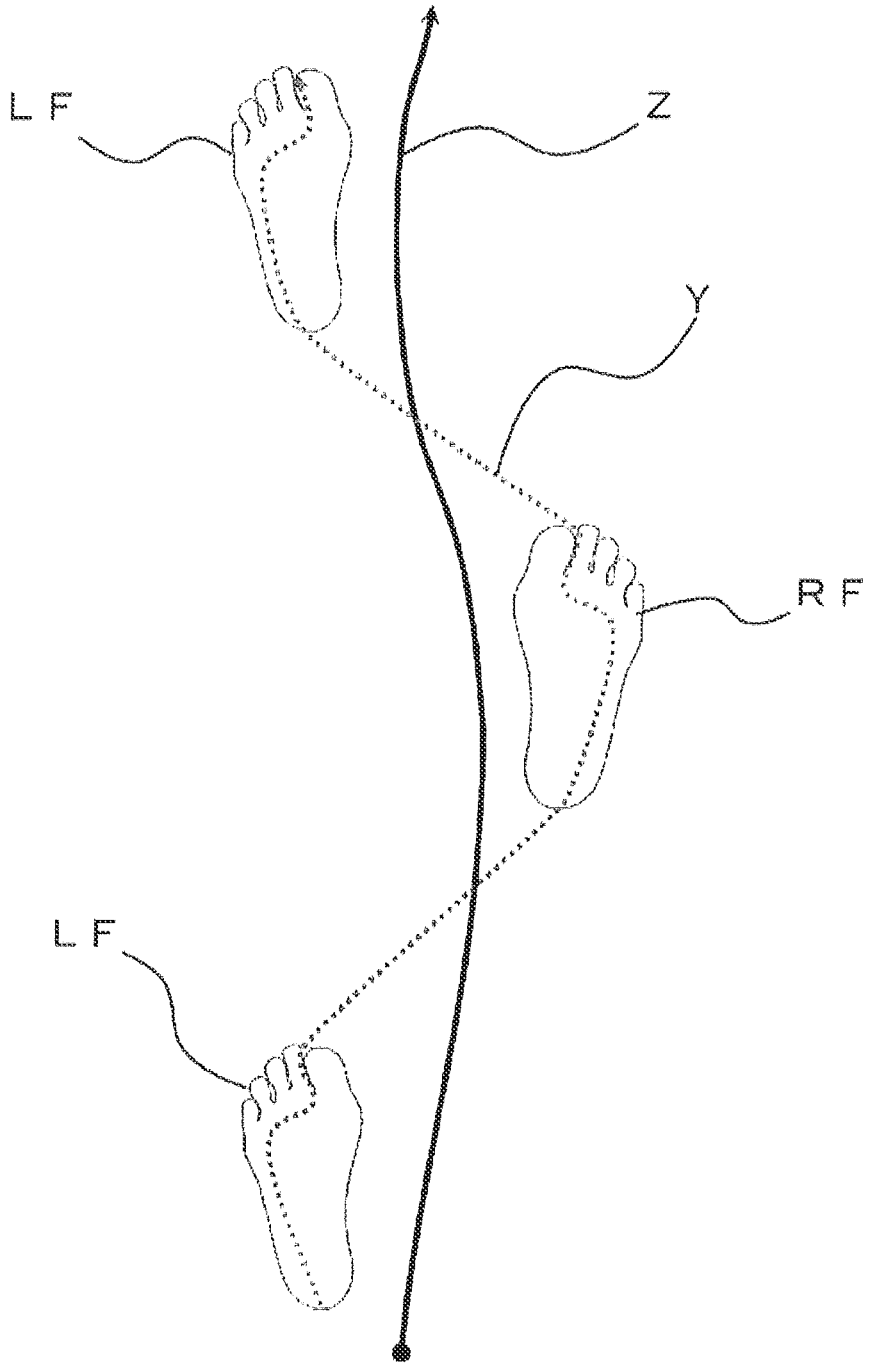
FIG. 2 is a schematic view illustrating movement trajectories of a COP and the center of body gravity.

In other words, in respective arch structures of the foot formed in the forefoot area A, the midfoot area B, and the hindfoot area C, the protrusions 32, 33, 34, respectively, push up outer sides of the arches higher than inner sides of the arches, to thereby act to suppress the excessive outward displacement of the COP illustrated in FIG. 2. As a result, the center of body gravity 26 is corrected so as not to be excessively displaced outwards, and thereby the movement of the center of body gravity 26 is purposely optimized. Accordingly, it is possible to lead to an efficient motion.

The heights T1, T2, T3, respectively, of the protrusions 32, 33, 34 may be the same height depending on the foot shape or the like of the user. Alternatively, the heights T1, T2, T2 may be distinctive from one another. For example, in the case of the average person's foot, an experiment shows that it is preferable to set the height in the forefoot area A to about 1.5 mm to 7 mm, the height in the midfoot area B to about 0.1 mm to 10 mm, and the height in the hindfoot area C to about 1.5 mm to 10 mm. The relation between the COP and the center of body gravity 26 of the person differs between individuals and therefore, the heights T1, T2, T3 are adjusted so as so correspond to each user.

As illustrated in the illustration (A) of FIG. 4, each of the protrusions 32, 33, 34 has a cross-section, along a line X-X direction in the illustration (A) of FIG. 3, that is formed to correspond to the foot shape into a shape providing a gradual and gentle curve in an inwardly and downwardly inclining manner from a top end of each of the protrusions 32, 33, 34 toward an inner side. It should be noted that this shape is provided for the purpose of being fitted to the foot of the user. That is, this shape is not a necessary shape to suppress the excessive outward displacement of the COP.

For example, as illustrated in the illustration (B) of FIG. 4, the outer forefoot protrusion 32 may be formed into an approximately circular arch shape in which a corner is rounded. As illustrated in the illustration (C) of FIG. 4, the outer forefoot protrusion 32 may be formed into a square shape to the extent not giving discomfort to the foot of the user. Furthermore, as illustrated in the illustration (D) of FIG. 4, even when an outer upper part of the outer forefoot protrusion 32 is formed into a square shape, it is possible to have an effect of the present invention. That is, the shape of the outer forefoot protrusion 32 can be determined in light of case of manufacture (work), a manufacturing cost, and the like.

FIG. 4 is a cross-sectional view of the outer forefoot protrusion 32 along the line X-X, not a cross-sectional view of the outer midfoot protrusion 33 or the outer hindfoot protrusion 34. However, the outer midfoot protrusion 33 and the outer hindfoot protrusion 34 can be formed into the same shape. Regarding a positional relation in inner side-outer side directions, each of the protrusions 33, 34, 35 may be formed without a space (gap) from the outer edge part 31*a* as illustrated in the illustration (A) of FIG. 4 or may be formed so as to depart (be distanced) from the outer edge 31 as illustrated in the illustrations (B), (C) of FIG. 4.

According to the insole 30 of the embodiment of the present invention, the top surface 31*b* of the insole 30 is divided into three areas including the forefoot area A, the midfoot area B, and the hindfoot area C. Furthermore, in the outer section E, all the three areas including the forefoot area A, the midfoot area B, and the hindfoot area C, respectively, are provided with the outer forefoot protrusion 32, the outer midfoot protrusion 33, and the outer hindfoot protrusion 34 having the heights of 0.2 mm or higher and 15 mm or lower from the top surface 31*b* of the insole 30. Thus, the following three effects are mainly provided.

(i) Effect to Suppress Outward Displacement of COP

In the case of golf, for example, upon the COP being displaced outwards during swing, it is difficult to convert a translational force to be generated during the swing into a rotational force. The present invention suppresses and/or reduces such a difficulty, to thereby increase the rotational force and thus improve performance.

Furthermore, in the case of running, when an end point of the COP trajectory Y in the foot is located between the hallux and the rest of toes, it is possible to allow powerful push-off toward a running direction. However, when the end point is located at another part (for example, the fourth toe or an inner side of the hallux), such a location of the end point not only makes it impossible to allow ideal push-off and, but also often leads to injury. The present invention can prevent these problems.

In the case of soccer, as it is a sport often involving making turns to left and right, the excessive outward displacement of the COP immediately causes a sprain. The sprain not only decreases performance, but also poses a threat to an athlete's career. The present invention can prevent these problems.

In the case of a walking motion, as in the case of running, it is ideal that the end point of the COP trajectory Y is located between the hallux and the rest of toes. For walking, however, the speed is slower and frontward propulsion capability is lower than running. Thus, the excessive outward displacement of the COP easily occurs. Furthermore, as walking is a motion to be performed daily, even a small load on a joint can be accumulated and often leads to severe arthritis. The present invention can prevent these problems.

(ii) Physical Effect (Edge Effect)

The insole 30 is designed to be higher in the outer section E than in the inner section D, Thus, the user uses an edge of an outer part inside the shoe, to thereby easily obtain a force to quickly make a turn inwards. Such an effect improves instantaneous capability in sports such as soccer that involve a number of turns. In the case of golf, the edge effect properly leads to a motion of the foot and achieves a stable swing primarily by a rotational movement (in which swaying is suppressed).

(iii) Effect to Stimulate Foot Function

Today, there is a very high percentage of people whose little toes do not contact the ground. Increasing the height of an outer part of the forefoot area A up to 15 mm improves a ground contact capability of the fourth and little toes on the ground and thus allows heel-off of the foot in the outer section E. Furthermore, compressing the flexor digiti minimi brevis and the abductor digiti minimi of the foot improves activity of the fourth and little toes and, thereby stimulating the little toe in terms of muscle activity. Consequently, these two effects improve functionality of the foot in the outer section E, thereby leading to an efficient motion in which the excessive outward displacement of the center of body gravity 26 is suppressed during walking.

Furthermore, there is the peroneus longus running to the outer part of the midfoot area B, which is an important part to change directions of the foot. Compressing this part improves activity of the peroneus longus in addition to the above-described muscles. The peroneus longus is known to act when the foot is planted on the ground using the inner ball of the foot, and is very important muscle in various sports and a motion such as walking. Furthermore, the peroneal muscles are distinctive muscles, among a group of muscles starting from the lower leg, that can move the COP to an inner side (hallux-side) of the foot. In other words, the peroneal muscles are essential for ideally controlling the COP and the center of body gravity. Accordingly, as a result of the above-described stimulation of muscles, the heel-off of the foot in the inner section D (hallux-side) of the foot is improved, and thereby it is possible to suppress the excessive outward displacement of the COP and consequently to lead to an efficient motion in which the excessive outward displacement of the center of body gravity 26 is suppressed during walking.

Furthermore, the heights of the outer forefoot protrusion 32, the outer midfoot protrusion 33, and the outer hindfoot protrusion 34 are set to 0.2 mm or higher and 11 mm or lower, or are set to 0.2 mm or higher or 7 mm or lower. As a result, it is possible to decrease a possibility that the user complains of discomfort in the height of each of the protrusions 32, 33, 34.

Although the insole 30 of the first embodiment of the present disclosure has been described hereinabove, the present invention is not limited to the embodiment discussed above and can be variously modified and changed based on the technical idea of the present invention.

There are three protrusions including the outer forefoot protrusion 32, the outer midfoot protrusion 33, and the outer hindfoot protrusion 34 formed individually in the present embodiment. The effect to suppress the excessive outward displacement of the COP can be obtained even when, for example, each of these protrusions is provided as a single protrusion or two protrusions of these three protrusions are combined. Examples of combination include a combination of the outer forefoot protrusion 32 and the outer hindfoot protrusion 34, and a combination of the outer forefoot protrusion 32 and the outer midfoot protrusion 33. Although these three protrusions are provided for the common purpose of suppressing the excessive outward displacement of the COP, effects of these protrusions on the body are distinctive from one another. The outer forefoot protrusion 32 properly guides a direction of the push-off of the toes toward an inner direction. The outer midfoot protrusion 33 properly guides the position of the COP toward the inner direction in response to a load being imposed on the entire foot sole. The outer hindfoot protrusion 34 guides the moving direction of the COP, at the moment of contact of the heel with the ground, so as to suppress the moving direction of the COP excessively turning outwards. The present invention is a shape that is adjusted so as to bring an effect best suited and matched to an individual by using the respective effects of these three protrusions independently or in combination. This shape can bring the best effect to suppress the excessive outward displacement of the COP by providing all the three protrusions 32, 33, 34.

Figure 6:
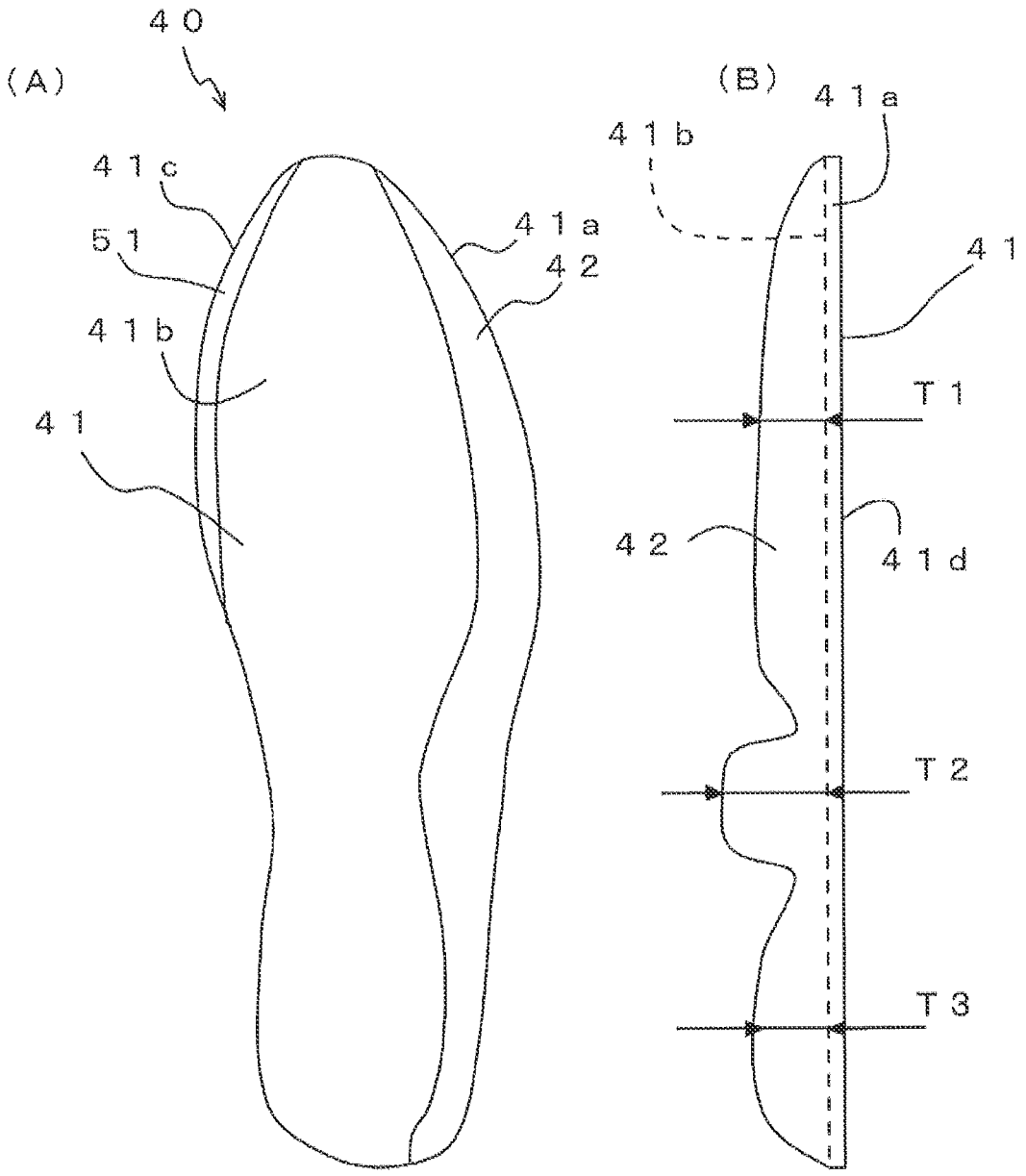
FIG. 6 is a modified example of the present invention, in which an illustration (A) is a plane view of an insole and an illustration (B) is a right-side view of the illustration (A).

Furthermore, in the present embodiment, each of the three protrusions 32, 33, 34 are provided in a manner to be distinctive from one another and ensure that the metatarsal 18, the cuboid bone 14, and the like are individually pushed up. However, as illustrated in FIG. 6, these protrusions 32, 33, 34 may be configured as a continuous and integral protrusion 42. According to this configuration, it is possible to reduce complicated molding and/or working for an insole 40 and further improve productivity.

Even when these protrusions 32, 33, 34 are configured as the integral protrusion 42, it is possible to provide the insole 40, which is the best for the user, by adjusting the heights T1, T2, T3, respectively, to 0.2 mm or higher in the forefoot area A, the midfoot area B, and the hindfoot area C, and to heights best suited to the respective areas.

Figure 7:
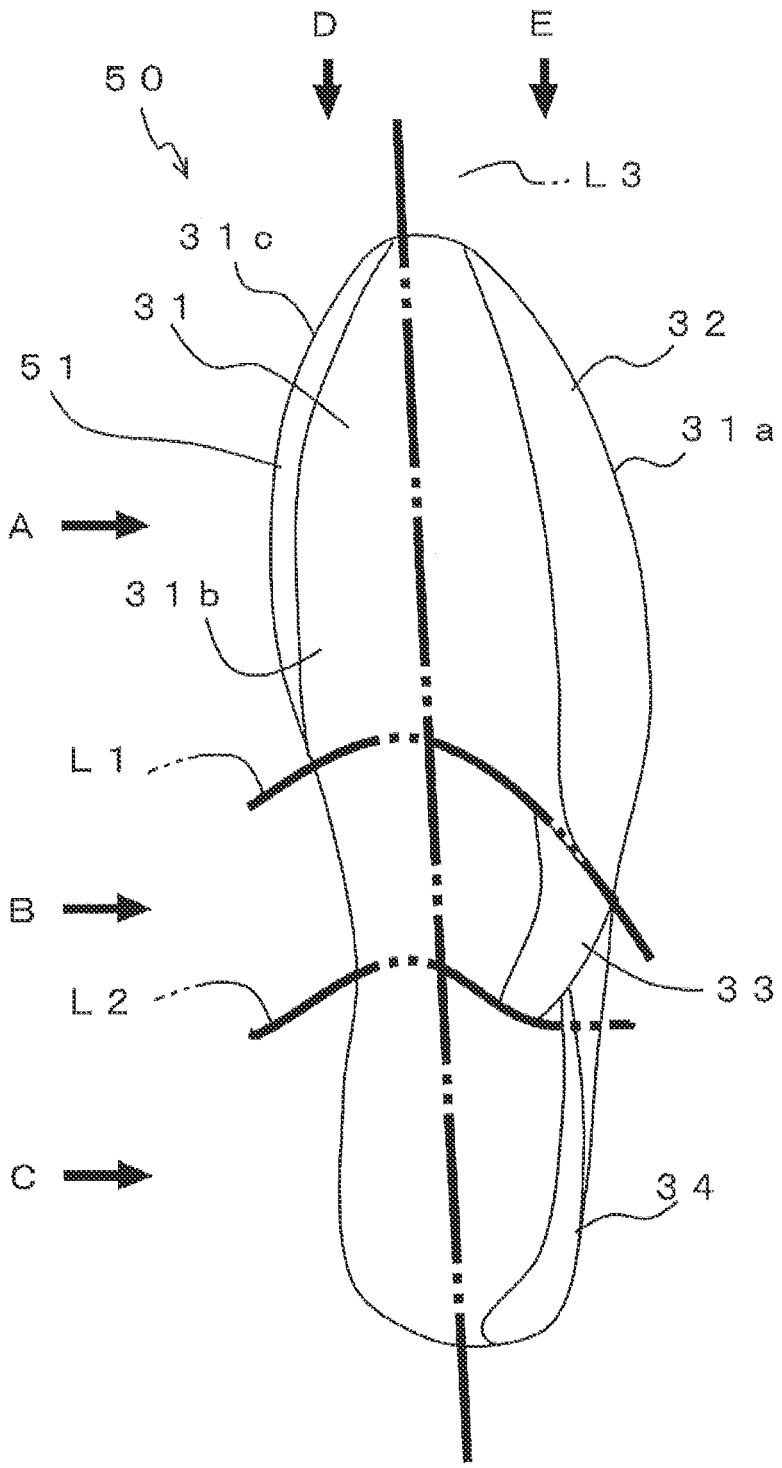
FIG. 7 is a plane view of an insole according to a modified example of the present invention.

Furthermore, in addition to the present embodiment, there may be provided, in an inner edge part 31*c* of the sole insert 31 located in the forefoot area A in the inner section D, an inner forefoot protrusion (second protrusion) 51 protruding upwards from the top surface 31*b*, as illustrated in FIG. 7. Furthermore, as in the aforementioned modified example, the inner forefoot protrusion 51 may be provided to the insole 40, which is provided with each protrusion as a single protrusion. Alternatively, the inner forefoot protrusion 51 may be provided to the insole 40, which is provided with two protrusions in combination among the three protrusions. Furthermore, as illustrated in FIG. 6 described above, even when the integral protrusion 42 are provided, an inner edge part 41*c* may be provided with the inner forefoot protrusion 51. The height of this inner forefoot protrusion 51 is also set to 0.2 mm or higher and 15 mm or lower, preferably 0.2 mm or higher and 11 mm or lower, and more preferably 0.2 mm or higher and 7 mm or lower.

The inner forefoot protrusion 51 is formed in a manner to extend from a front leading end of the sole insert 31 to the area line L1 along the inner edge part 31*c*. Furthermore, the inner forefoot protrusion 51 has the same cross-sectional shape as the shape illustrated in FIG. 4. The inner forefoot protrusion 51 does not have a function to push up the human foot bones upwards, but is directed to fix the hallux to a specific position so as to suppress displacement of the hallux, to thereby improve the push-off force with the hallux. That is, it is possible to further enhance the effect to suppress the excessive outward displacement of the COP by performing a passive control in which the three protrusions 32, 33, 34 suppress outward movement of the COP and combining the passive control with an active control to improve the push-off force with the hallux by restricting the position of the forefoot area A in the inner section D using the inner forefoot protrusion 51.

Alternatively, although the three protrusions 32, 33, 34 protrude upwards from the top surface 31*b* of the sole insert 31 in the present embodiment, these three protrusions 32, 33, 34 may protrude downwards from a bottom surface 31*d* of the sole insert 31 (a back surface in the plane of paper of the illustration (A) of FIG. 3, this surface being a reference point to define a height of each protrusion when the protrusion protrudes downwards). As in the present embodiment, downward heights of these three protrusions are also set to 0.2 mm or higher and 15 mm or lower, preferably 0.2 mm or higher and 11 mm or lower, and more preferably 0.2 mm or higher and 7 mm or lower. That is, the three protrusions 32, 33, 34 may have any configurations in which bones such as the metatarsal 18 can be pushed up upwards with functions of these protrusions. The inner forefoot protrusion 51 described above may also protrude downwards from the bottom surface 41*d*.

Second Embodiment

Most COPs in sports and daily motions often start at the heel of the foot or a part in the vicinity of the heel (hereinafter, referred to as COP start point) and end at the tip toe (COP end point). For example, in ordinary walking, it can be said to be ideal that the heal contacts the ground first and the COP ends at a part between the hallux and the second toe. Furthermore, in the foot (typically, the right foot) that is distal from a target in golf swing, it can be said to be ideal that the COP ends at an inner side of the hallux. As described, the magnitude and the direction of the push-off are determined depending on which toe the COP end point is located close or specifically what part of the toe the COP end point is located at. The resulting force determines a moving direction and a moving speed of the center of body gravity. Accordingly, a body motion is created.

According to anatomy and kinematics, it is most efficient when the COP end point is located in the vicinity of the hallux. This is because the hallux metatarsal 118*a*, the hallux proximal phalanx 119*a*, and the first distal phalanx 120*a* are larger than those of other toes and the hallux is distinctive from other toes in that it has an array of muscles that acts on the hallux alone. Locating the COP end point at an inappropriate part of the foot not only decreases sports performance, but also leads to occurrence of failure and pain in various motions including walking.

Furthermore, in humans who walk bipedally, there has been a social problem due to a difference between left and right feet in the position of the COP end point or the moving speed of the COP. Specifically, such a difference causes a difference between left and right feet in push-off force, which influences the entire lower limb, the pelvis, and the trunk of body as distortion and leads to various failures including pain.

The present invention is directed to allow creation of a motion suitable to the purpose by guiding the COP end point to a specific part of the foot in the vicinity of the hallux, thereby improving the push-off force with the specific part in the vicinity of the hallux or increasing/decreasing the push-off force of the left and right feet. It can be said to be a novel point that a protrusion is provided mainly in the forefoot part (in the vicinity of the toes).

Figure 8:
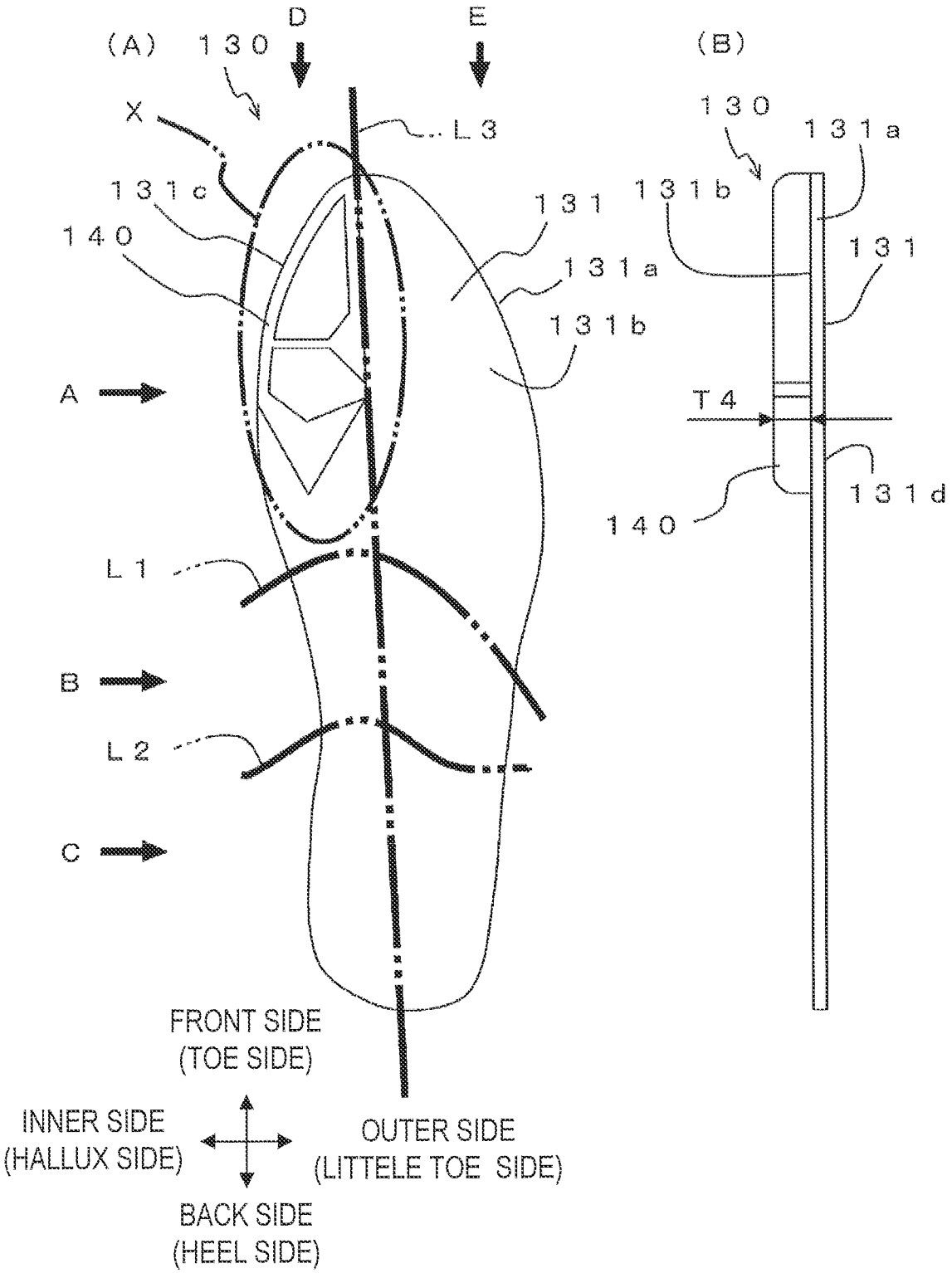
FIG. 8 is a view of the insole alone according to the embodiment of the present invention, in which an illustration (A) is a plane view and an illustration (B) is a right-side view of the illustration (A).
Figure 9:
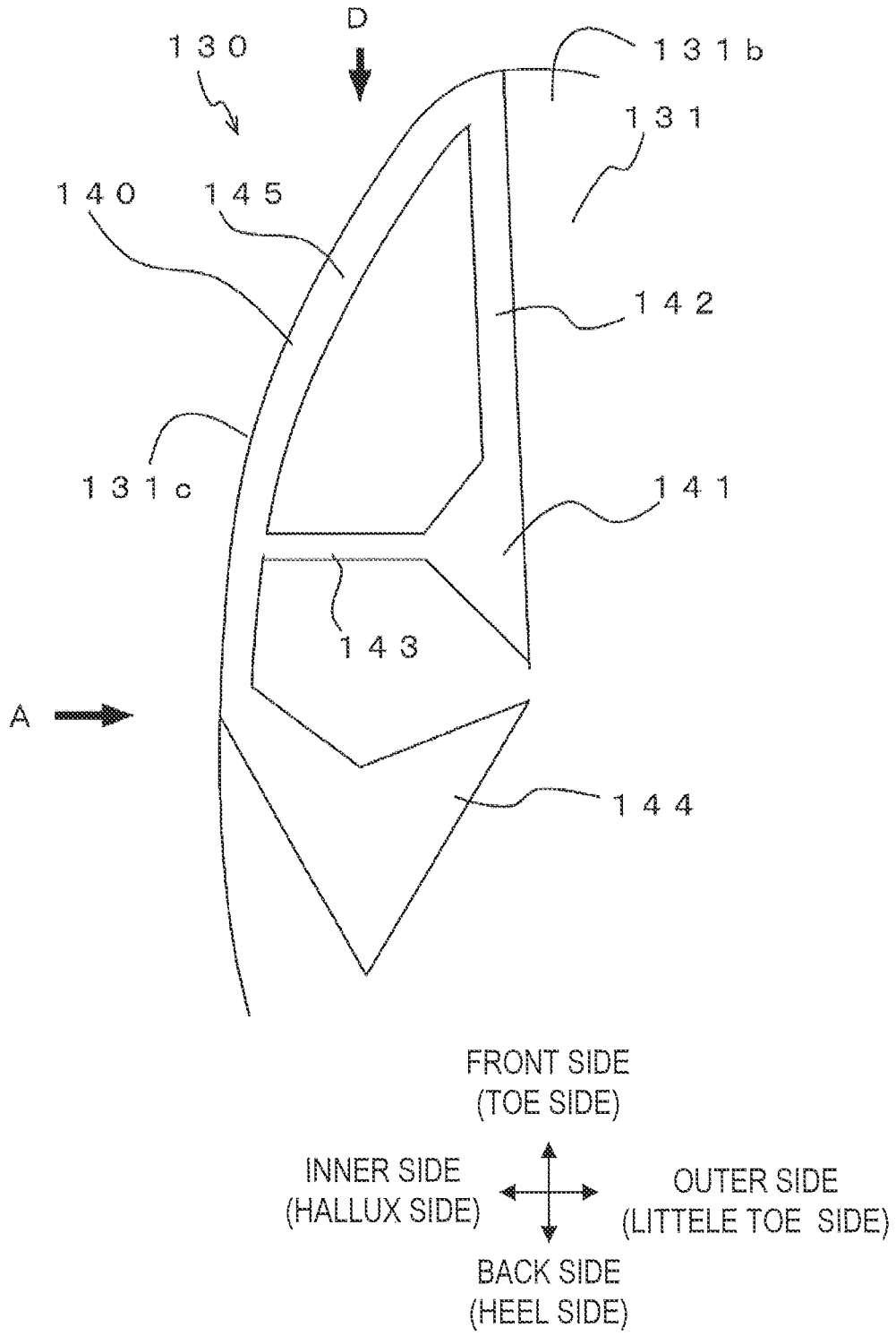
FIG. 9 is an enlarged view of an X part of FIG. 8.
Figure 10:
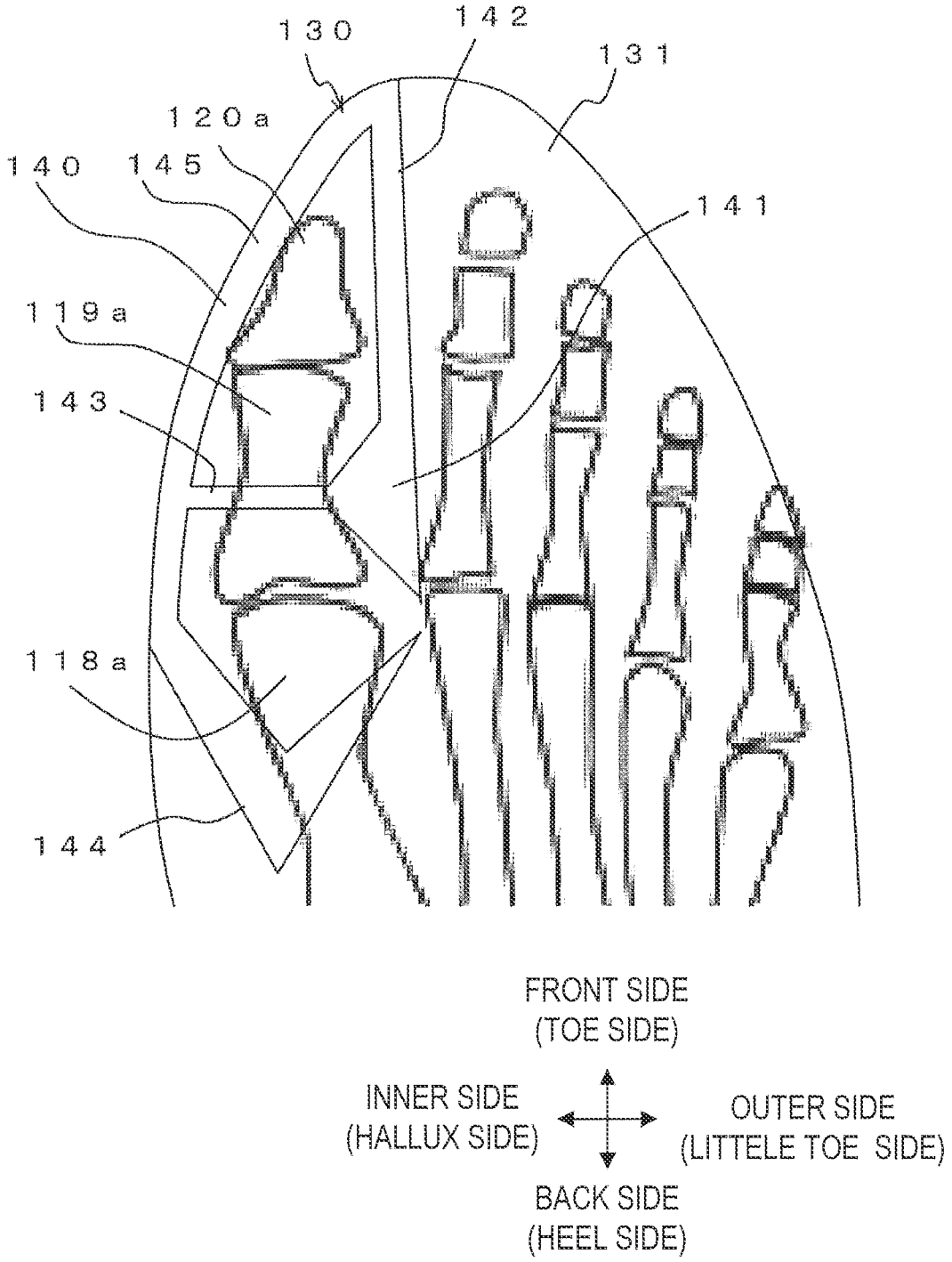
FIG. 10 is a schematic view illustrating a positional relation between the human foot bones and first through fifth protrusions as viewed in a plane.

FIG. 8 is an insole 130 according to an embodiment of the present invention. The illustration (A) of FIG. 8 is a plane view and the illustration (B) of FIG. 8 is a right-side view of the illustration (A). Furthermore, FIG. 9 is an enlarged view of a part X in the illustration (A) of FIG. 8. Still further, FIG. 10 is a schematic view showing a positional relation between the foot bones and the first through the fifth protrusions as viewed in a plane.

The insole 130 illustrated in FIG. 8 is for the right foot, and a left foot insole has a bilaterally symmetric configuration. For this reason, the following descriptions are given to the insole 130 for the right foot, and descriptions of the left foot insole are omitted. It should be noted that a strict comparison shows, when performed, that the left and right feet have bilaterally asymmetric shapes depending on the user (because it is necessary to correct a movement trajectory of the COP generated due to variations of left and right feet soles). However, on the premise that such asymmetry is within individual differences, the descriptions proceed, deeming the left and right feet to be bilaterally symmetric.

Furthermore, the insole referred in the present invention includes insoles to be pre-sewn to shoes during a production process of the shoes as well as insoles to be separately placed in fabricated shoes by the user.

As illustrated in the illustration (A) of FIG. 8, the insole 130 is formed to have a shape similar to a contour shape (middle sole shape) that matches the inside of a shoe. The insole 130 is divided into 6 areas by area lines L1, L2, L3 as viewed from the top. These area lines L1, L2, L3 and the division of the insole 130 into areas A through E are determined based on the structure of the foot bones 1 of humans as illustrated in FIG. 5.

The foot bones 1 of humans can be divided into three areas A, B, and C in front-rear directions. Specifically, the three areas A, B, and C are: a forefoot area A (a distal part from the Lisfranc joint consisting of the first through fifth metatarsals 18 and the first through fifth phalanges 19 (the term "first through fifth" refers to the first toe (hallux), the second toe (long toe), the third toe (middle toe), the fourth toe (ring toe), and the fifth toe (little toe). The term "phalanges" is a collective term of the proximal phalanx, the middle phalanx, and the distal phalanx); a midfoot area B (between the Chopart joint and the Lisfranc joint consisting of cuneiform bones 11, 12, 13, a cuboid bone 14, and a navicular bone 15); and a hindfoot area C (a proximal part to the Chopart joint consisting of a calcaneus 17 and a talus bone 16). The area lines L1, L2 are lines to schematically divide the foot bones 1 into these areas A, B, and C.

Furthermore, there is provided the single area line L3, connecting the leading end of the second toe to the most posterior protrusion of the calcaneus approximately perpendicular to the plane of paper of FIG. 5, to thereby divide the foot bones 1 into two areas (the inner section D, the outer section E) on the left and right across the area line L3.

The positions of the area lines L1 through L3 illustrated in FIG. 5, respectively, correspond to the positions of the area lines L1 through L3 illustrated in the illustration (A) of FIG. 8.

The insole 130 comprises a sole insert 131 having a fixed thickness and a shape traced so as to match an inner shape of the shoe; and set of inner forefoot protrusions 140 protruding upwards from a top surface 131*b* of this sole insert 131. Furthermore, as illustrated in FIG. 9, the set of inner forefoot protrusions 140 comprises, within an area partitioned by the area lines L1, L3 in the forefoot area A in the inner section D, five protrusions (a first protrusion 141, a second protrusion 142, a third protrusion 143, a fourth protrusion 144, and a fifth protrusion 145).

As the protrusions 141, 142, 143, 144, 145 of the set of protrusions 140 are formed integrally with the sole insert 131, the insole 130 is finished into a desired shape and/or the height thereof is adjusted by cutting the sole insert 131. Furthermore, the set of protrusions 140 may be formed without integrally forming the protrusions 141, 142, 143, 144, 145 with the sole insert 131. For example, the set of protrusions 140 can be formed by attaching, to the sole insert 131 having the top surface 131*b* formed to be flat, the protrusions 141 through 145 that are formed separately.

As illustrated in FIG. 10, these first through fifth protrusions 141, 142, 143, 144, 145 are arranged so as to surround an outer periphery of the hallux as viewed in a plane. These protrusions 141, 142, 143, 144, 145 exhibit functions and effects distinctive from one another due to respective positions and shapes.

As illustrated in FIGS. 8 and 9, the first protrusion 141 is positioned in a vicinity of the proximal phalanx 119*a* between the hallux and the second toe (between toes, in the vicinity of bases of the toes) of the foot. The first protrusion 141 is formed into an approximately triangle shape that has one side extending in front-rear directions along the second toe and that has a vertex inward of this side. The first protrusion 141 is a protrusion having dimensions of: 5 mm to 30 mm in a lateral direction (inner side-outer side directions); 5 mm to 40 mm in the front-rear directions; and 1 mm to 7 mm in a height direction (thickness direction; a measurement T4 in the illustration (B) of FIG. 8) in FIG. 9.

The first protrusion 141 may have, for example, a quadrangle shape or an oval shape different from the approximately triangle shape described above. The shape of the first protrusion 141 can be appropriately changed to match the shape of the vicinity of the proximal phalanx 119*a* between the hallux and the second toe of the user.

The second protrusion 142 includes its base part in the vicinity of a front side of the first protrusion 141 and extends in a toe direction. The second protrusion 142 is a protrusion having dimensions of: 2 mm to 10 mm in the lateral direction (the inner side-outer side directions); 5 mm to a length reaching to a leading end of a toe part of the insole 130 in the front-rear directions; and 1 mm to 7 mm in the height direction along T4 in FIG. 9.

The second protrusion 142 is formed into any elongated shape, such as a rectangular shape and an oval shape. Furthermore, the base part of the second protrusion 142 does not necessarily contact (not necessarily continuous with) the first protrusion 141, and maybe formed to be spaced from the first protrusion 141.

The third protrusion 143 includes its base part in the vicinity of an inner side with respect to the first protrusion and extends across the hallux proximal phalanx 119*a* in an inner-side direction (direction toward the hallux). The third protrusion 143 is a protrusion having dimensions of: 5 mm to a length reaching to an inner edge of the insole 130 in the lateral direction (the inner side-outer side directions); 2 mm to 10 mm in the front-rear directions; and 1 mm to 7 mm in the height direction along T4 in FIG. 4.

As in the second protrusion 142, the third protrusion 143 is formed into any elongated shape, such as a rectangular shape and an oval shape. Furthermore, the base part of the third protrusion 143 does not necessarily contact (not necessarily continuous with) the first protrusion 141, the fifth protrusion 145 to be described below, and the inner edge of the insole 130, and may be formed to be spaced from these parts.

The fourth protrusion 144 is formed into an approximately V-shape so as to conform to a vicinity of a rear edge of the inner ball of the foot (in the vicinity of an edge proximal to the head of the hallux metatarsal 118*a*). The fourth protrusion 144 is arranged such that a heal-side end thereof extends up to a center of an inner side cuneiform bone. Furthermore, the fourth protrusion 144 is a protrusion having a height of 1 mm to 10 mm in the height direction along T4.

The fourth protrusion 144 has any V-shape such as an approximately U-shape or may be formed into a shape similar to the approximately U-shape. The fourth protrusion 144 does not necessarily contact (is not necessarily continuous with) the first protrusion 141 described above and the fifth protrusion 145 to be described below and may be formed to be spaced from these parts.

The fifth protrusion 145 is arranged along a curve of an inner edge part 131*c* of the insole 130 from the vicinity of the rear edge of the inner ball of the foot or a vicinity of an inward side of the hallux phalanx. The fifth protrusion 145 is a protrusion having dimensions of: 2 mm to 15 mm in the lateral direction (the inner side-outer side directions); 15 mm up to a length reaching to the leading end of the toe part of the insole 130 in the font-rear directions; and 1 mm to 7 mm in the height direction along T4 in FIG. 9.

The fifth protrusion 145 has any shape based on the foot shape of the user. For example, the fifth protrusion 145 does not necessarily contact the inner edge of the insole 130 along its curve and may be formed with a gap provided from the inner edge of the insole 130. Furthermore, the fifth protrusion 145 does not necessarily contact (is not necessarily continuous with) the fourth protrusion 144.

Among these first through fifth protrusions 141, 142, 143, 144, 145, only one protrusion can be provided as a single protrusion or a combination of two protrusions (or a combination of three, four or five protrusions) can be provided in accordance with foot bone conditions of the user.

By increasing the number of protrusions combined, it is possible to increase the push-off force with the specific part of the vicinity of the hallux. In other words, by changing the number of protrusions combined and/or combination patters, it is possible to change the degree of the push-off force with the specific part in the vicinity of the hallux or the degree of guiding the COP to the vicinity of the hallux. As a result, it is possible to lead to a motion best suited to the purpose. Accordingly, the first through fifth protrusions 141, 142, 143, 144, 145 each are sometimes used as a single protrusion and, at other times, they are used in combination.

In one case, the first through fifth protrusions 141, 142, 143, 144, 145 are used in addition to an existing insole shape to support an arch shape of the foot sole. In another case, the first through fifth protrusions 141, 142, 143, 144, 145 are configured with themselves alone. Here, the existing insole shape refers to an object having a shape, except a flat shape, to support a foot sole structure for various purposes. When the first through fifth protrusions 141, 142, 143, 144, 145 are added to the existing insole shape, their heights are defined up to the respective thickest points thereof from zero height (start) set at a surface of the existing insole shape (surface of the existing insole shape formed in a plane of the top surface 131*b*), which is just below these protrusions and has these protrusions arranged thereon.

Furthermore, when the first through fifth protrusions 141, 142, 143, 144, 145 are configured with themselves alone, the heights of these protrusions are defined up to the respective thickest points thereof from the zero height (start) set at the surface (the top surface 131*b*), which is just below these protrusions and has these protrusions arranged thereon.

Still further, even when the first through fifth protrusions 141, 142, 143, 144, 145 are cut integrally with the existing insole shape, heights of these protrusions are defined up to their respective thickest points from the zero height (start) to be set at a surface configuring these protrusions just below them (a surface of the existing insole shape formed in a plane of the top surface 131*b* on the assumption that the inner forefoot protrusions are not yet formed).

By using the first through fifth protrusions 141, 142, 143, 144, 145 in combination as necessary, in light of characteristics of the user, determinations are made to a way of combination, a length in the lateral direction (the inner side-outer side direction), a length in the front-rear directions, a length in the height direction, a width, and the like within numerical ranges described above. These numerical ranges were obtained based on the result of experimental use of the technology of the present invention for 2500 users or more in advance.

According to the insole 130 according to the second embodiment of the present invention, the top surface 131*b* of the insole 130 is divided into the three areas including the forefoot area A, the midfoot area B, and the hindfoot area C. Furthermore, in the inner section D in the forefoot area A, there is provided the set of inner forefoot protrusions 140 that protrudes upwards or downwards from the top surface 131*b* or a bottom surface 131*d* of the insole 130 and that is arranged to surround the periphery of the hallux as viewed in a plane. Thus, it is possible to encourage the foot to perform push-off with the part in the vicinity the hallux and improve the push-off force when the center of gravity is moved during walking and playing of sports.

Furthermore, the set of inner forefoot protrusions 140 comprises at least one of: the first protrusion 141 arranged in the vicinity of the proximal phalanx 119*a* between the hallux and the second toe of the foot; the second protrusion 142 extending from the first protrusion 141 in the toe direction; or the third protrusion 143 extending from the first protrusion 141 in the direction toward the hallux across the hallux proximal phalanx 119*a*. As a result, the first protrusion 141, the second protrusion 142, and the third protrusion 143 make it easier for the user to recognize a boundary between the hallux and the second toe based on a principle similar to the principle that the tabi socks and sandal thongs allows more focus to be on the toes. This principle is considered based on the brain science as follows. On the foot sole, particularly within a daily shoe, when the foot experiences a partial pressure change in the vicinity of a toe that infrequently feels a protrusion, a sensory receptor of the foot sole is stimulated and recognizes the presence of the first through third protrusions 141, 142, 143. The sense recognized is then processed in the cerebrum. Ultimately, sensitivity to the sense derived from these protrusions 141, 142, 143 are improved. Furthermore, a predictive reaction of the cerebrum in a region to store and understand effects brought by these protrusions 141, 142, 143 further increases the sensitivity of the sensory receptor of the foot sole. It is considered that these biological reactions can lead to a motion to heel-off with parts in the vicinity of the protrusions 141, 142, 143.

Furthermore, when respective pressures from the first through third protrusions 141, 142, 143 continue for a long period of time, the foot rather gets used to the pressures, resulting in decrease in recognition with respect to these protrusions 141, 142, 143. However, even when the recognition decreases, sensory information regarding these pressures continues to be sent to the brain at all times (the information is transmitted to the brain through a spinal pathway distinctive from a spinal pathway used in case where the protrusions 141, 142, 143 are being recognized). This information is mainly processed in the cerebellum and an effect to promote quality of movement, efficiency of movement, and learning of precision of movement can be expected.

Figure 11:
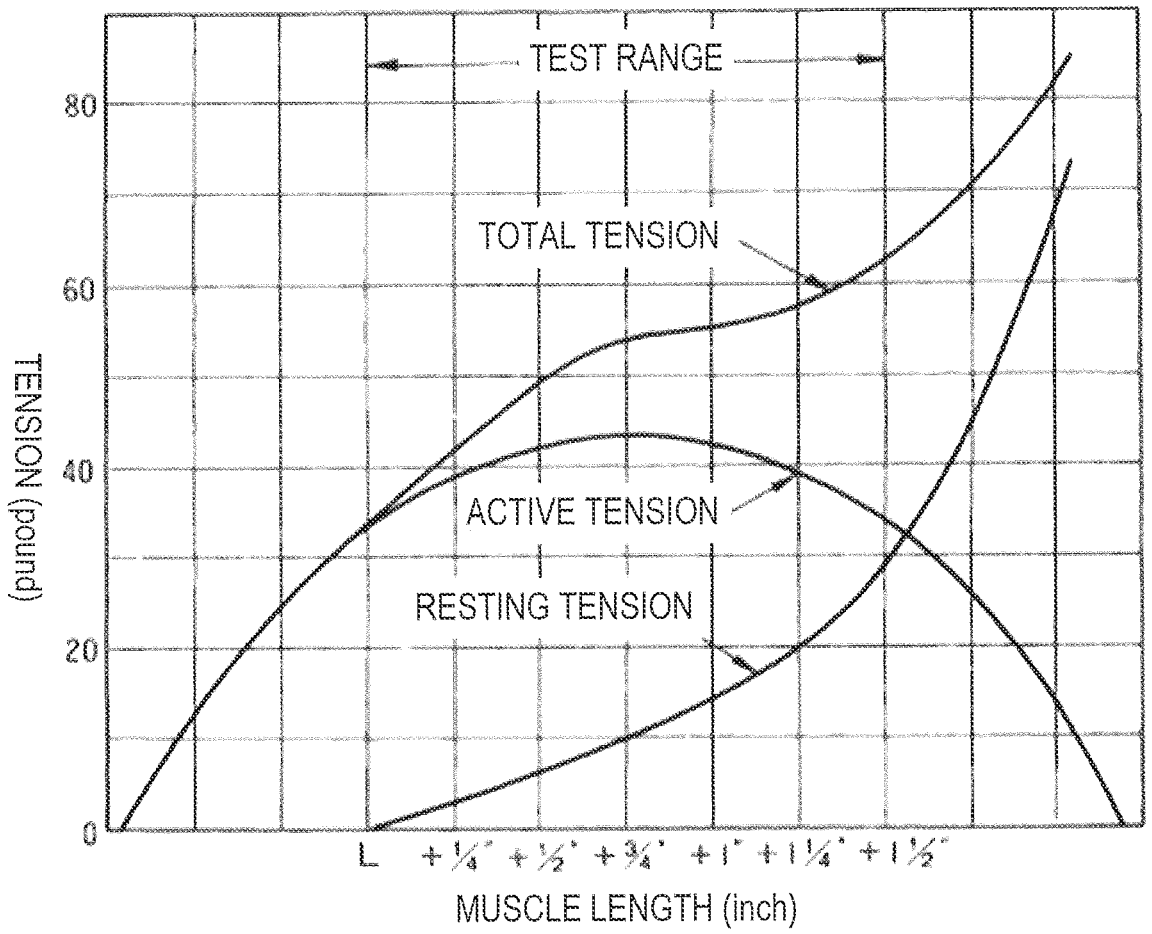
FIG. 11 is a graph diagram showing a relation between muscle length and tension.

Still further, as the set of inner forefoot protrusions 140 comprises the fourth protrusion 144 arranged so as to conform to the vicinity of the rear edge of the inner ball of the foot, this fourth protrusion 144 stabilizes the rear edge of the inner ball of the foot, to thereby assist efficient gait initiation using the hallux and provide structural stability. Due to a pressure from the fourth protrusion 144, lengths of muscles of the foot sole (flexor hallucis longus, abductor hallucis, adductor halluces, flexor hallucis brevis) to produce heel-off (concentric plantar flexion and eccentric plantar flexion) with the hallux are increased (stretched tight). Consequently, it is possible to improve a contraction force of the muscles. This can be explained based on a graph of a relation between the muscle length and the tension shown in FIG. 11. When a muscle is stretched, overall muscle tension is improved in comparison with a case when a muscle is relaxed. Using these physiological characteristics makes it possible to encourage more powerful push-off in the vicinity of the hallux with the fourth protrusion 144 provided to the foot sole, or to bring out a potential ability, to thereby encourage a power to be spontaneously exhibited.

Still further, due to the set of inner forefoot protrusions 140 comprising the fifth protrusion 145 arranged along a curve of the inner edge part 131*c* of the insole from the vicinity of the rear edge of the inner ball of the foot or a vicinity of the hallux phalanx, this fifth protrusion 145 stabilizes an inner edge of the hallux and acts so as to encourage the push-off with the part in the vicinity of the hallux. The hallux has a round configuration in its entirety and the bottom part of the hallux, in its entirety, does not contact an inside of the shoe. Thus, arranging the fifth protrusion 145 to the inner side of the hallux results in expansion of a ground contact area of the hallux in the inner-side direction and thus assists the push-off. This protrusion is advantageous not only in the push-off in the toe direction, but also during a motion to perform the heel-off with an inner part of the hallux as in the playing characteristics of golf.

Still further, the first through fifth protrusions 141, 142, 143, 144, 145 are combined, to thereby lead to a frontward push-off or an inward push-off with the specific part in the vicinity of the hallux and stabilize a structure of the part itself in the vicinity of the hallux. This can be said to be a novel technology applicable to various fields as most sports and daily life motions include an element to move the center of body gravity frontwards and inwards.

Although the insole 130 according to the second embodiment of the present invention has been described hereinabove, the present invention is not limited to the embodiments discussed above and can be variously modified and changed based on the technical idea of the present invention.

In the present embodiment, the first through fifth protrusions 141, 142, 143, 144, 145 protrude upwards from the top surface 131*b* of the sole insert 131. However, for example, these protrusions may protrude downwards from the bottom surface 131*d* of the sole insert 131 (a back surface in the plane of paper of the illustration (A) of FIG. 8, this surface being a reference point to define the height of each protrusion when the protrusion protrudes downwards). That is, the first through fifth protrusions 141, 142, 143, 144, 145 may have any configurations in which the functions thereof can improve perception and sense in the vicinity of the hallux and can obtain stability of bones and increase in muscle tension in the vicinity of the hallux.

Furthermore, although the descriptions have been given to the insole 130 to be placed as a shoe insert in the present embodiment, it is also possible to provide the set of inner forefoot protrusions 140 (the first through fifth protrusions 141, 142, 143, 144, 145) to a midsole to be integrally equipped with a footwear. Here, the midsole refers to, for example, a member where the foot sole directly contacts a footwear without the insole 130. Examples of the midsole include a part of a sandal to directly contact the foot sole. As in the insole 130 described above, even in the footwear including such a midsole provided with the set of inner forefoot protrusions 140, the set of inner forefoot protrusions 140 makes it possible to encourage the push-off with the specific part in the vicinity of the hallux and improve the push-off force based on the same mechanism as that of the insole.

EXPLANATION OF REFERENCE NUMERALS

1 . . . foot bones, 11, 12, 13 . . . cuneiform bone, 14 . . . cuboid bone, 15 . . . navicular bone, 16 talus bone, 17 . . . calcaneus, 18 . . . fifth metatarsal, 19 . . . fifth phalanx, 20 . . . fourth metatarsal, 21 . . . fourth phalanx, 22 . . . simulated hip joint, 23 . . . simulated knee joint, 24 . . . simulated foot joint, 25 . . . foot, 26 . . . center of body gravity, 30, 40, 50 . . . insole, 31, 41 . . . sole insert, 31*a* . . . outer edge, 31*b* . . . top surface, 31*c*, 41*c* . . . inner edge part, 31*d*, 41*d* . . . bottom surface, 32 . . . outer forefoot protrusion (protrusion), 33 . . . outer midfoot protrusion (protrusion), 34 . . . outer hindfoot protrusion (protrusion), 42 . . . integral protrusion, 51 . . . inner forefoot protrusion (second protrusion), 118*a* . . . hallux metatarsal, 119*a* . . . hallux proximal phalanx, 120*a* . . . hallux distal phalanx, 130 . . . insole, 131 . . . sole insert, 131*a* . . . outer edge part, 131*b* . . . top surface, 131*c* . . . inner edge part, 131*d* . . . bottom surface, 140 . . . set of inner forefoot protrusions, 141 . . . first protrusion, 142 . . . second protrusion, 143 . . . third protrusion, 144 . . . fourth protrusion, 145 . . . fifth protrusion, A . . . forefoot area, B . . . midfoot area, C . . . hindfoot area, D . . . inner section, E . . . outer section, L1, L2, L3 . . . area line, LF . . . left foot, RF . . . right foot, T1, T2, T3, T4 . . . height, W1 . . . load, W2 . . . ground reaction force, Y . . . movement trajectory of COP, Z . . . movement trajectory of center of body gravity

The invention claimed is:

1. An insole to be used as a shoe insert, comprising:

a forefoot area;

a midfoot area; and a hindfoot area, the forefoot area comprising, in its inner part, a combination of the following items:

a first protrusion (i) arranged in a vicinity of a proximal phalanx between a hallux and a second toe, (ii) having a triangular shape that has one side extending in a front-rear direction along the second toe as viewed from above or below, (iii) and protruding upward from a top surface of the insole or downward from a bottom surface of the insole, and a second protrusion extending in a toe direction from the vicinity of the proximal phalanx and protruding upward from the top surface of the insole or downward from the bottom surface of the insole.

2. The insole according to claim 1, wherein the triangular shape has a vertex arranged inward of the one side.

3. The insole according to claim 1, wherein the second protrusion has an elongated shape as viewed from above or below.

4. The insole according to claim 1, further comprising at least one of the following items:

a third protrusion extending from the vicinity of the proximal phalanx in a direction toward the hallux across the hallux and protruding upward from the top surface of the insole or downward from the bottom surface of the insole, a fourth protrusion arranged so as to conform to a vicinity of a rear edge of an inner ball of a foot and protruding upward from the top surface of the insole or downward from the bottom surface of the insole, and a fifth protrusion arranged along a curve of an inner edge of the insole from the vicinity of the rear edge of the inner ball of the foot and protruding upward from the top surface of the insole or downward from the bottom surface of the insole.

5. The insole according to claim 4, wherein the forefoot area comprises, in its inner part, at least the first protrusion, the second protrusion, and the fourth protrusion, and wherein the fourth protrusion has an approximately V-shape as viewed from above or below.

* * * * *